United States Patent [19]

Noé

[11] 4,079,615

[45] Mar. 21, 1978

[54] TENSIONING APPARATUS FOR CONTINUOUS STRIP, ESPECIALLY METAL STRIP AND BANDS

[75] Inventor: Oskar Felix Noé, Mulheim an der Ruhr, Germany

[73] Assignee: BWG Bergwerk- und Walzwerk-Maschinenbau GmbH, Duisburg, Germany

[21] Appl. No.: 764,957

[22] Filed: Feb. 2, 1977

[30] Foreign Application Priority Data

Jun. 5, 1976 Germany ..... 2625414

[51] Int. Cl.[2] ..... B21B 39/08

[52] U.S. Cl. ..... 72/205; 72/249

[58] Field of Search ..... 72/205, 249; 226/195

[56] References Cited

U.S. PATENT DOCUMENTS

| | | | |
|---|---|---|---|
| 3,798,951 | 3/1974 | Fornataro | 72/249 X |
| 3,867,826 | 2/1975 | Noé | 72/249 X |

*Primary Examiner*—Milton S. Mehr

*Attorney, Agent, or Firm*—Karl F. Ross

[57] ABSTRACT

A tensioning apparatus for metal strip, e.g. for advancing the metal strip through a processing station, for stretching the metal strip, or the like, comprises at least two sets of rolls (bridles) each comprising a pair of rolls in spaced apart relationship with the strip extending between the sets and over and under shooting respective rolls thereof. The drive system comprises a drive motor connected to one of the rolls of one of the sets (bridles) through a superimposing transmission (e.g. a three-element differential), one element of which is connected to the motor, another element of which is connected to the roll and a third element of which is connected by a shaft to a corresponding roll of the other pair via a similar three-element superimposition transmission. Another element of the latter transmission is connected to the roll of this other pair while a hydraulic motor is connected to the third element. Other rolls of the two sets are driven via hydraulic motors and/or similar transmissions, the hydraulic motors being connected to a common pressure line with controlled pressure so that the torques supplied to the rolls successively engaging the band are stepped.

10 Claims, 10 Drawing Figures

TENSIONING APPARATUS FOR CONTINUOUS STRIP, ESPECIALLY METAL STRIP AND BANDS

FIELD OF THE INVENTION

The present invention relates to a tensioning apparatus for continuously moving bands and especially metal strip having at least two sets bridles of tensioning drums or rolls at spaced-apart locations, each set of rolls bridle including at least a pair of such drums or rolls which can be alternately overshot and undershot by the hand.

BACKGROUND OF THE INVENTION

Tensioning apparatus for continuously moving metal strip can be employed in stretch-bending leveling devices for the straightening of metal strip, dressing frames, pickling lines, galvanizing lines or the like. Such apparatus serves to stretch, tension and displace the metal strips and, especially when stretching is desired for strengthening or straightening the metal strip, apply a predetermined stretch thereto during the processing of the metal strip.

The tension is applied to the metal strip generally with the aid of sets bridles of stretching drums or rolls which can be alternately overshot and undershot by the metal strip and which frictionally engage the metal strip, the drums of each set being positioned relative to one another such that the metal band passing around each drum extends through arcs in excess of 180° and preferably of about 225° around each roll or drum. Because of the large surface contact of the drum with the strip, the surface friction is high and special means is not required to maintain the strip in contact with the surface of the drum or prevent substantial slippage between them.

To obtain a predetermined degree of stretch, i.e. elongation, while applying a continuous tension to the band or strip, the rolls are driven with successively higher peripheral speeds and hence, if they are of the same diameter, successively higher angular velocities and can have stepped torques to accomplish this stretching from roll to roll or between steps of rolls.

Between the upstream and downstream sets, a precise torque distribution must be maintained for the individual drums to prevent fluttering of the band or excessive stretching at one location and insufficient tension at another. If the torque distribution is not precise, the stretch of the band does not correspond to the peripheral speeds of the rollers and the desired degree of stretch cannot be maintained.

To compensate for the different angular velocities of the individual drums, in order to ensure operation of the drums at corresponding peripheral speeds as the strip stretches, i.e. corresponding to increasingly band length, various drive and control systems have been proposed for the drums to ensure the precise distribution of the tension force, compensatory angular velocity increases between the upstream and downstream sides of the system, etc.

In one conventional system, a purely hydraulic drive arrangement is provided between the individual stretching drums or rolls. Thus, between the inlet and outlet sides of the system, the drums are provided with respective hydraulic motors and, on the inlet side, these motors function as pumps while at the outlet side, the hydraulic machines function as motors, the high pressure side of the hydraulic machines being connected to a common pressure line whose pressure is maintained or established by a controllable pressurizing pump.

The torques of the hydraulic motors, or, more generally hydraulic machines, are stepped in accordance with the stressing force which must be applied at each such drum. The pumps at the upstream side and the motors at the downstream side are fed in opposite directions (with respect to hydraulic-fluid flow) by the pressurizing pump so that a tension is applied to the strip.

While this system permits predetermined tension forces to be maintained or established, these hydraulic motors and pump arrangements have significant disadvantages.

While the hydraulic motors allow compensation of the angular velocities of the drums to the increase of strip length and can be used as the primary band or strip transport source, for the application of considerable tensions of, for example, to order of thirty million kg-force (30Mp) the hydraulic system is extremely expensive. This is especially the case since the duct work, cooling arrangements, filter devices, pumps and motors must be capable of handling several thousand liters of the hydraulic medium per minute (see for example German Published application — Offenlegungsschrift No. 16 52 615).

In order to obviate this disadvantage, the applicant has proposed earlier a hydromechanical system which has been described in his commonly assigned U.S. Pat. No. 3,722,776 which issued Mar. 27, 1973. This patent describes an apparatus for the tensioning of continuously displaced metal strip using at least two sets of stressing drums, i.e. at least one pair of rolls at the intake side and at least one pair of rolls at the discharge or downstream side, the band passing alternately over and under the rolls or drums of each set.

In this system, each tension drum is provided with a differential transmission which is constituted as a superimposition transmission, the two transmissions being provided in parallel with one being coupled to the extreme drums or rolls of the two sets while the other is coupled to the inner drums or rolls of the two sets. Motors can be provided to the other imputs of the differential transmissions to effect the necessary speed and torque equalization inputs.

The inputs of these motors is thus superimposed upon the transmissions coupling the corresponding rolls so that the motors can be termed superimposed motors. Since the transmissions serve as means for superimposing an additional drive source on the system, they can be termed superimposition transmissions in the sense required for an understanding of this invention.

The superimposition input of each superimposition transmission is thus connected to one of the superimposition motors to effect torque control.

While this system has been found to be highly useful for the purposes described above, it has required some improvement.

For example, the system has limited versatility and it has not been possible, for instance, to provide the drums in different planes offset from one another or disposed one above another. This limits the use of the system of planes which can accommodate an arrangement of the rolls or drums in a common plane.

Moreover, when the drums are to be operated with small torques, a system having numerous differential transmissions coupling each pair of corresponding drums is relatively expensive.

OBJECT OF THE INVENTION

It is the principal object of the present invention to provide an improved tensioning apparatus for continuously displaced strip especially metal strip, for the purposes described, which *eliminates* the expensive hydraulic systems hitherto necessary in some cases to generate the staggered torque, which is more versatile than the prior-art systems, which is of relatively low cost, which can generate a wide range of staggered torques, and which, in general, extends the principles described in the aforementioned patent.

SUMMARY OF THE INVENTION

These objects and others which will become apparent hereinafter are attained, in accordance with the present invention, in a tensioning apparatus which comprises at least two rolls or drums at an upstream side (upstream bridle) and at least two drums or rolls at a downstream side (downstream bridle), the drums or rolls at the upstream side constituting a first set or bridle and the drums or rolls at the downstream side constituting a second set or bridle of the stressing rolls about which the preferably metal strip is slung in opposite directions as it passes continuously through each set and between the sets from the downstream side to the upstream side.

According to the invention, one of the rolls of one of the sets or bridles is provided with a superimposition transmission of the three-element differential type and a corresponding roll of the other set or bridle is provided with a differential transmission of the three-element type, one element of each of these two transmissions being directly connected by a common shaft for synchronous rotation while a second element of each transmission is connected to a respective roll, and a third element is provided at each transmission.

According to the invention, the third element of the transmission of the other set, usually the downstream set, is driven by a motor, e.g. an electric motor, while the third element of the first-set transmission is provided with a hydraulic machine of the pump-motor type which is connected to a common hydraulic line with hydraulic motors which can be connected to other rolls of the two sets or bridles and also are tied to this line. The line, in turn, is fed by a variable-output pressure-controlling pump.

For the purposes of the present invention, a superimposition transmission will be understood to be a three-element differential transmission of any conventional type. A typical transmission of this type may have a sun gear, a pair of planetary gears connected to a planetary gear carrier which mesh with the sun gear and are rotatable relative to the carrier, and a further gear which meshes with the planetary gears and which is rotatable in turn relative to the sun gear and the planetary gear carrier. This further gear may be a ring gear surrounding the planetary gear carrier. In this construction, all of the gears can lie in the same plane, the sun gear and its shaft constituting one element of the differential transmission, the planetary gear carrier constituting a second element and the ring gear constituting a third element of the transmission. All three elements are relatively rotatable and are displaced differentially. Accordingly, if the speeds of any two of these elements are determined, the direction and speed of the third will likewise be determined and, correspondingly, the relative rotation rates and torques between any two of the elements can be determined by the input of a torque to the third element.

Another differential transmission fulfilling the purposes of the present invention can have a sun gear and a planet carrier, the sun gear being a bevel gear and the planetary gears being in turn bevel gears. Another sun gear meshing with the planetary gears can constitute the third element or the third element may be a ring gear as described. In this case the gears need not lie in a common plane.

For the purposes of the present invention, moreover, two such transmissions will always be provided, one for a roll of one of the sets, the other for a roll of the other set and each will be provided with a differential transmission of this type. One element will always be directly connected with the respective roll, another element of each transmission will be directly coupled by a common shaft, e.g. via suitable direction-change or angle-change gearing, while inputs can be provided at the third elements of each transmission, preferably via at least one hydraulic motor.

Of course, when the band is propelled by extrinsic means, e.g. by other rolls, both of the third elements can be driven by hydraulic motors. Normally, however, the driving input to the system, e.g. via an electric motor, will be applied to the third element of one of these transmissions while the third element of the other will be operated by a hydraulic motor.

According to the invention, moreover, the term "hydraulic motor" should be understood to mean "hydraulic machine" in the broadest sense. In general terms, a hydraulic machine can act interchangeably as a hydraulic motor or a hydraulic pump, especially rotary hydraulic machines such as axial-piston machines widely used because they permit adjustment of fluid throughput and mechanical output per unit of hydraulic throughput. These machines are preferred for the purposes of the present invention. If the strip draws the roll in an angular movement, because of a retarding torque on the roll, its hydraulic motor can act as a pump and force fluid into the common duct. Conversely, when the pressure of the fluid supplied to the input side of the hydraulic machine is sufficient to exert a torque on the roll in the direction of displacement of the band, it will function purely as a hydraulic motor and contribute a driving force to the system. Thus the term "hydraulic machine" must be understood to mean either a hydraulic motor/or a hydraulic pump, the two terms being interchangeable depending upon whether the roll is entrained by the band or the roll entrains the band in the direction of travel.

More specifically the invention provides that at least two stressing drums are provided at the upstream or inlet side of the apparatus and at least two stressing drums are provided at the downstream or discharge side of the apparatus and at least one drum of each of these sets or pairs (bridles) is provided with a superimposition transmission formed as a differential transmission having a superimposition input for controlling the torque and constituted by a superimposition motor, while a common shaft connects other elements of these two transmissions. The other drums are each provided with a drive system including a torque-controllable hydraulic machine (hydraulic motor) as described above and the superimposition motor and the hydraulic motors are connected with torque stepping to a common pressure line with controllable fluid pressure, i.e. supplied by a controllable pressure pump.

According to the invention, therefore, a hydraulic tensioning is obtained in combination with a hydromechanical system embodying some of the principles of my aforementioned patent, whereby the overall arrangement can operate without an expensive hydraulic system can be more flexible in its ability to compensate for different spatial requirements, and has high versatility in the degree and nature of the stress forces and operations which can be applied.

For example, the superimposition transmission with its superimposition motor and the hydraulic motors can be so applied that only stressing drums with low torque are hydraulically stressed, thereby reducing the requisite hydraulic medium circulation and limiting the ductwork, cooling systems and filter devices which are necessary. The latter approach reduces leakage losses.

Since a part of the tension is applied by hydromechanical means, the number of shafts necessary to connect corresponding drums or rolls can be reduced, the lengths of the common shafts connecting the superimposition transmissions can be minimized and flexibility between hydraulic tensioning and hydromechanic tensioning can be achieved in that complete elimination of Cardan or universal joints shafts is possible in spite of the fact that some of the drums may lie in different horizontal planes from others.

It has also been found to be especially advantageous that the strip drive is effected hydromechanically and in the case of high required driving power or forces, the hydraulic motors for the hydraulic tensioning system can participate as drive motors.

More generally, however, the hydraulic motors can serve as control motors or pumps for regulating the stepping of the torque between the rolls or drums.

A most significant advantage is that numerous rolls can be used selectively or in combination at both the upstream and downstream sides with the respective hydraulic motors being cut in and out whenever required so that an exact distribution of torques and a uniform differential speed of the drums can be obtained regardless of the number of drums which are used and in accordance with stretching requirements.

Preferably the superimposition transmissions with their superimposition motors and the hydraulic machines (motors or pumps) are disposed at the inlet or upstream side mirror-symmetrically to the disposition at the outlet or downstream side. For example, respective stressing drums with high torques at the upstream and downstream sides can be provided with the superimposition transmissions and the respective superimposition motors while the tension drums operating with lowered torque are driven by hydraulic motors only.

According to still another feature of the invention, four or more stressing rolls are provided at the intake or upstream side and four or more tension rolls are provided at the downstream or discharge side with one or more of the drums at each side being connected by superimposition transmissions and the aforementioned common shaft, but with respective superimposition motors while the remaining drums are each driven by a respective hydraulic machine (pump or motor).

With four such drums at each side, only one of the drums, generally the first and last drum can be driven directly by a hydraulic motor or pump, the hydraulic machines thus serving as control motors or pumps. The remaining rolls or drums can be coupled together via the aforementioned three-element transmissions and a common shaft.

The advantages obtained with the present invention are numerous.

Firstly, the device is highly effective for continuous strip materials, especially metal strips, in that it eliminates expensive hydraulic system which must circulate large amounts of hydraulic medium while nevertheless obtaining the compensating effect hitherto characteristic of exclusively hydraulic arrangements. Secondly, the torque and speed compensations are obtained by a combination of hydraulic tensioning and hydromechanical tensioning so that, at a minimum of capital cost, the system is effective for drums which lie in different horizontal planes as well as for a system in which all of the drums lie in a common horizontal plane.

As noted, the peripheral speeds of drums of the same diameter can be stepped as required while the desired drum torques are maintained in a stepped manner. The system thus permits for a reliable, simple and accurate stressing of the metal strip.

It is of special significance that the orientation and positioning of the drums is not limited by the drive and torque-stepping systems and that the present system can be accommodated to existing stretching and strip-handling lines.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1A:
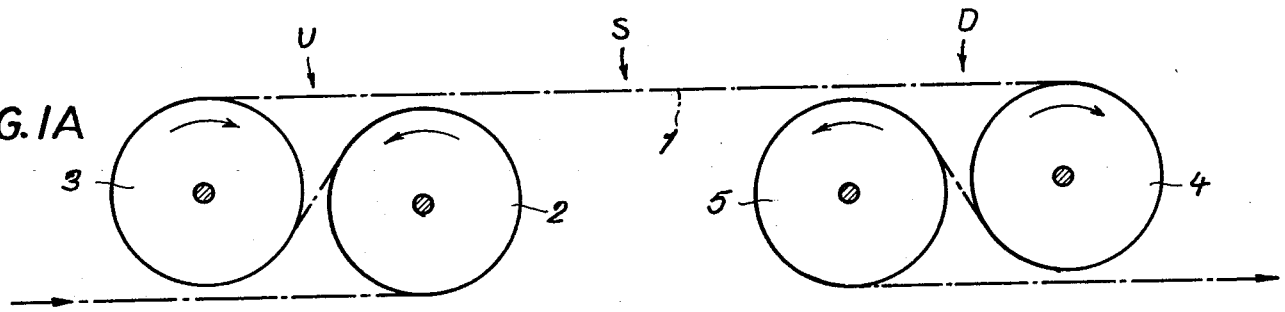
FIG. 1A is a section taken along the line IA — IA of FIG. 1.

In the description below certain elements of the several FIGURES have been illustrated with identical reference numerals since they perform essentially the same functions in all embodiments.

Figure 1:
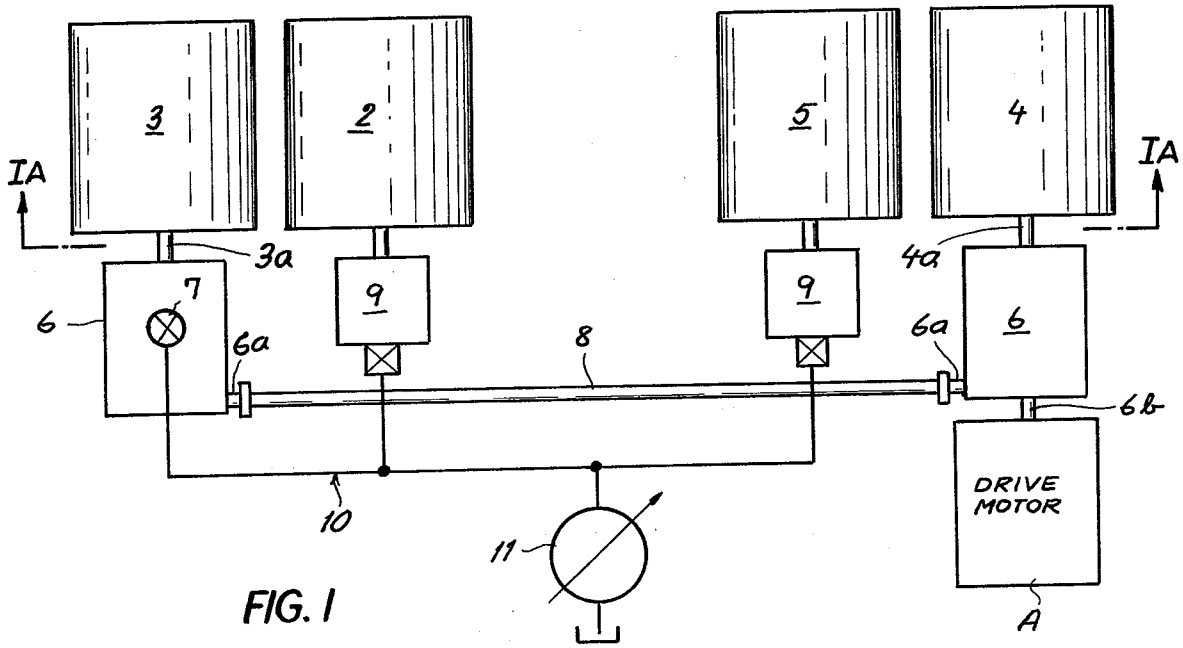
FIG. 1 is a schematic plan view, the band being omitted, of a stretching apparatus having two pairs of drums respectively at the upstream and downstream sides.

The embodiment of FIG. 1 comprises a pair of upstream rolls 2, 3 (upstream bridle), the metal strip 1 undershooting the roll or drum 2 and passing therearound through an angle of close to 225°. The strip then passes around the drum 3, undershooting this drum and also extending over an arc of approximately 225°. The strip 1 then passes in a horizontal stretch to the downstream drum 4 which is overshot by the strip which passes over the drum 5 to emerge in a horizontal pass beneath the set of drums 4, 5 (downstream bridle).

At the downstream drums as well, the strip subtends an arc substantially more than 180° and usually about 225°. The contact between the strip and the steel drums or rolls is purely frictional and, while the steel band may be advanced by other means not shown, it is possible to advance the band while stretching it with the apparatus illustrated in FIG. 1 as will be illustrated in greater detail below.

Figure 1B:
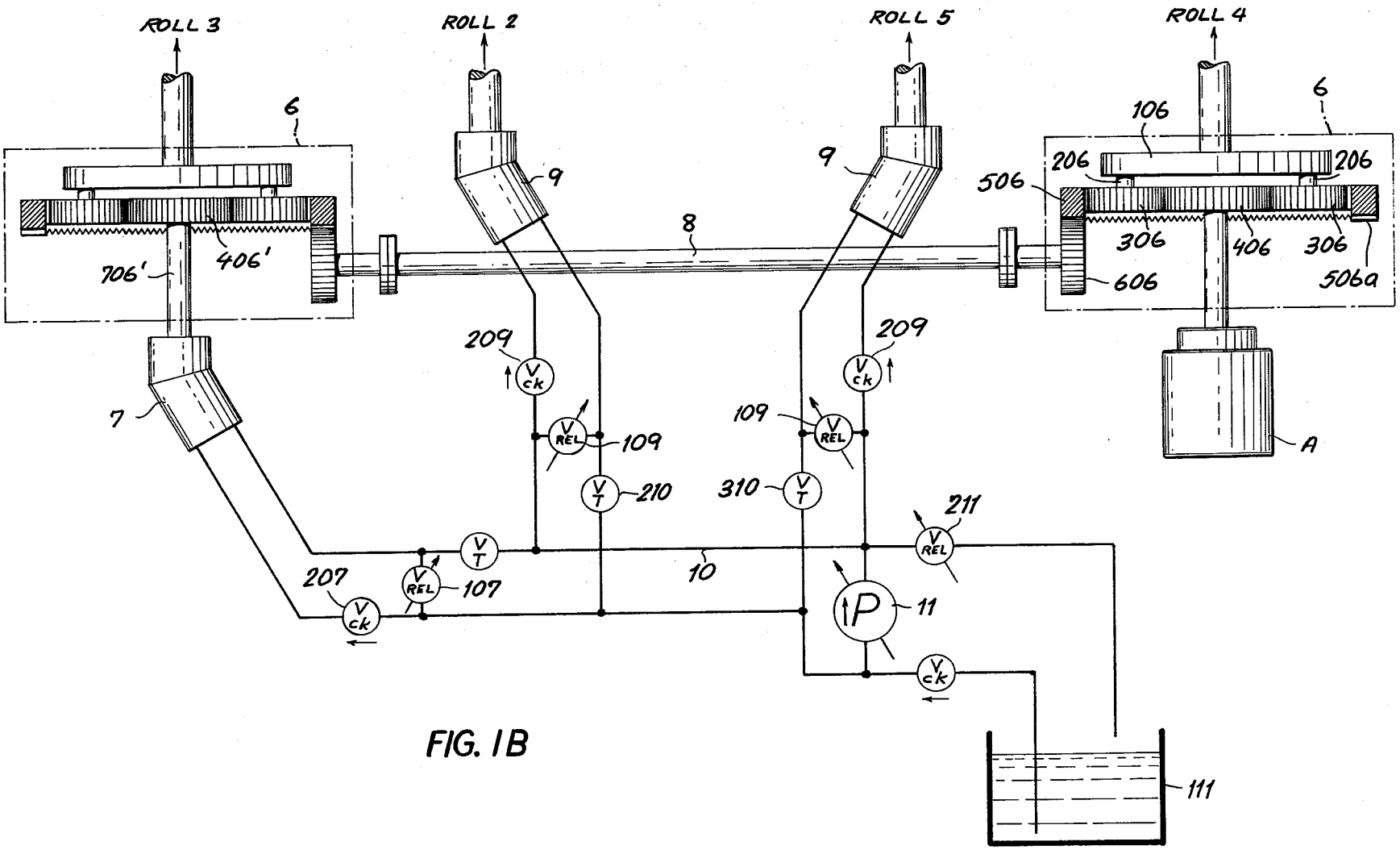
FIG. 1B is a somewhat diagrammatic view of the drive system for the embodiment of FIG. 1 illustrating other details.

The embodiment of FIGS. 1, 1A and 1B is being described in somewhat greater detail than those of the other systems since the principles which apply here are also applicable to the other systems and need not be individually mentioned. Suffice it to say that between the upstream set of drums U and the downstream set of drums D, there can be provided a station S at which various conventional operations can be performed on the band. These operations can be straightening, dressing, zinc plating, pickling or any other operation to which the steel band must be subjected.

Because the band is stretched between the drums of each set and between the two sets of drums, the drums 2, 3, 4, 5 have progressively increasing peripheral speed and, since they are all of the same diameter, their angular velocities must be likewise stepped. Furthermore, to maintain the desired tension of the band and to obtain the desird degree of stretch, the torque applied from drum to drum must progressively increase. If the drum 4 and the drum 5 are driven, the drums 2 and 3 can exert a drag on the strip to maintain this tension. To the extend that either of these drums can be directly driven by a hydraulic motor, therefore, this hydraulic motor or machine can act as a pump imposing the necessary drag. Conversely, since the hydraulic machines of the upstream drums must advance the strip, they perform as motors.

As can be seen from FIG. 1, the drums 3 and 4 are each provided with a superimposition three-element transmission 6 which will be described in somewhat greater detail below. The transmission for the drum 3 may have one element connected to the shaft 3*a* rotating the drum, a second element 6*a* connected to the common shaft 8 to be described in greater detail below, and a third element, differentially rotatable relative to the first two, which is driven by a hydraulic superimposition motor represented at 7.

The transmission 6 of the drum 4, however, can have its first element connected to the shaft 4*a* driving the drum, its second element 6*a* connected to the common shaft 8 and its third element 6*b* driven by a drive motor A which can be of the electrical type. Of course, when the strip 1 is driven by some other power source, not shown, the drive motor A can be replaced by a hydraulic motor 7 similar to the one described in connection with roll or drum 3.

A pressure-controlling, variable-displacement and variable-pressure pump 11 can have its output side connected to a common duct 10 which feeds the superimposition hydraulic motor 7 as well as a plurality of hydraulic motors represented at 9 which operate the other drums 2 and 5.

As can be seen from FIG. 1A, the drum 2 is driven in the counterclockwise sense while drum 3 is driven in the clockwise sense, drum 4 in the clockwise sense and drum 5 in the counterclockwise sense. Since drums 2 and 5 are operated in the same sense, their hydraulic motors 9 are driven in the same sense. Of course it is also possible to arrange the drums so that corresponding drums will be driven in opposite senses. In this case the hydraulic feeds to the hydraulic motors can be reversed.

FIG. 1B shows in somewhat greater detail the system of the present invention for controlling the rolls. For example, the three-element differential transmission connected to roll 4 and represented at 6 in FIG. 1 can comprise a planetary gear carrier 106 whose planet shafts 206 each carry respective planet gears 306 which mesh with a common sun gear 406 driven by the motor A. The planet gears 306 also mesh with a ring gear 506 which carries a crown of teeth 506*a* meshing with a pinion 606 which is tied to the common shaft 8.

The transmission connected to roll 3 is similarly constructed and, instead of having the sun gear 406' driven by the motor A, is provided with a hydraulic motor 7 which can be of the axial-piston, variable-stroke type which is coupled with the shaft 706' of the sun gear 406'.

For simplicity, wherever three element transmissions or superimposition transmissions are mentioned hereinafter, therefore, it will be understood that these transmissions can be of the type shown for roll 4 and can be coupled to any common shaft as indicated in FIG. 1B. Similarly, when superimposition hydraulic motors are used, they can be connected as is the motor 7 of the roll 3. Hydrostatic axial-piston motors of the type which can be used in accordance with the present invention have been described in *Fluid Power,* U.S. Government Printing Office, 1966, Washington DC.

The hydraulic motors or pumps 9 can be of similar construction and, while the hydraulic system was illustrated diagrammatically in FIG. 1, this system is seen in somewhat greater detail in FIG. 1B. Thus the pump 11 is provided with a reservoir 111 and a pressure relief valve 211 for controlling the pressure in its pressure-line 10. The latter may be connected to the various hydraulic motors 7, 9 via throttles 210 and 310, which can be controlled to stagger the torques applied to the respective motors which can have adjustable pressure relief throttles 107, 109 and check valves 207, 209 as illustrated. The check valves and relief valves facilitate control of the torques at the respective motors so that the torque can be stepped from the hydraulic motor roll 2 to the differential transmission of roll 3, to the differential transmission of roll 4 and to the hydraulic motor of roll 5, respectively. In the other embodiments of the apparatus described hereinafter it will be understood that similar hydraulic devices can be provided to maintain the torque and velocity staggering required as the strip passes from one end of the system to the other.

In all of the embodiments of the drawing, therefore, apparatuses illustrated for the stretching of a continuously moving band, especially metal strip, which comprises at least two tension drums 2, 3 at the upstream set and two stressing drums 4, 5 at the downstream set.

A pair of corresponding drums 3, 4 of the upstream and downstream sets are each provided with a respective differential sets are each provided with a respective differential transmission serving as a superimposition transmission 6 which has, at the superimposition input a respective torque-controlling superimposition hydraulic motor 7 or the drive motor A.

Both transmissions 6 have corresponding elements connected to a common shaft 8. Thus they are coupled together at the corresponding elements by these shafts. The other two corresponding drums 2, 5 are each provided with a respective torque-controlling hydraulic machine, e.g. a hydraulic pump in the case of drum 2 and a hydraulic motor in the case of drum 5 with, if desired, respective speed-changing transmissions which can be of the stepless or constant-ratio type. The superimposition motor 7 and hydraulic motors 9 are torque-stepped and are connected onto the common pressure line with controllable pressure, i.e. to a common hydraulic system 10 as described which includes a controllable pressure pump 11. The transmissions and hydraulic motors of the upstream set are in mirror symmetry to the transmission and hydraulic motors of the downstream set.

In the case of the embodiments of FIGS. 1, 1A and 1B, when each set only includes a pair of stressing drums, the superimposition transmissions are preferably provided on the terminal, i.e. outer drums, while the hydraulic motors are provided on the inner drums of course, since the strip passes from an inner drum to an outer drum and thence to an outer drum and inner drum, the hydraulic motors are coupled to the first and last drums in the direction of movement of the strip, while the superimposition transmissions are applied through the intermediate drums in this sense.

Figure 2A:
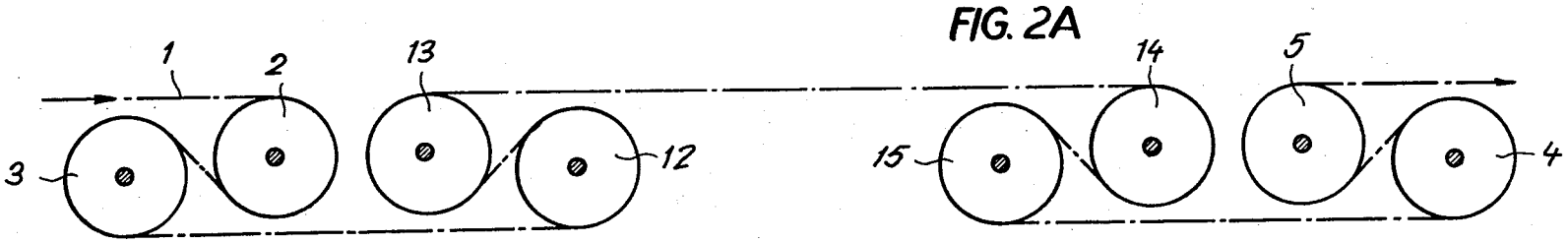
FIG. 2A is a sectional view taken along the line IIA — IIA of FIG. 2.
Figure 2:
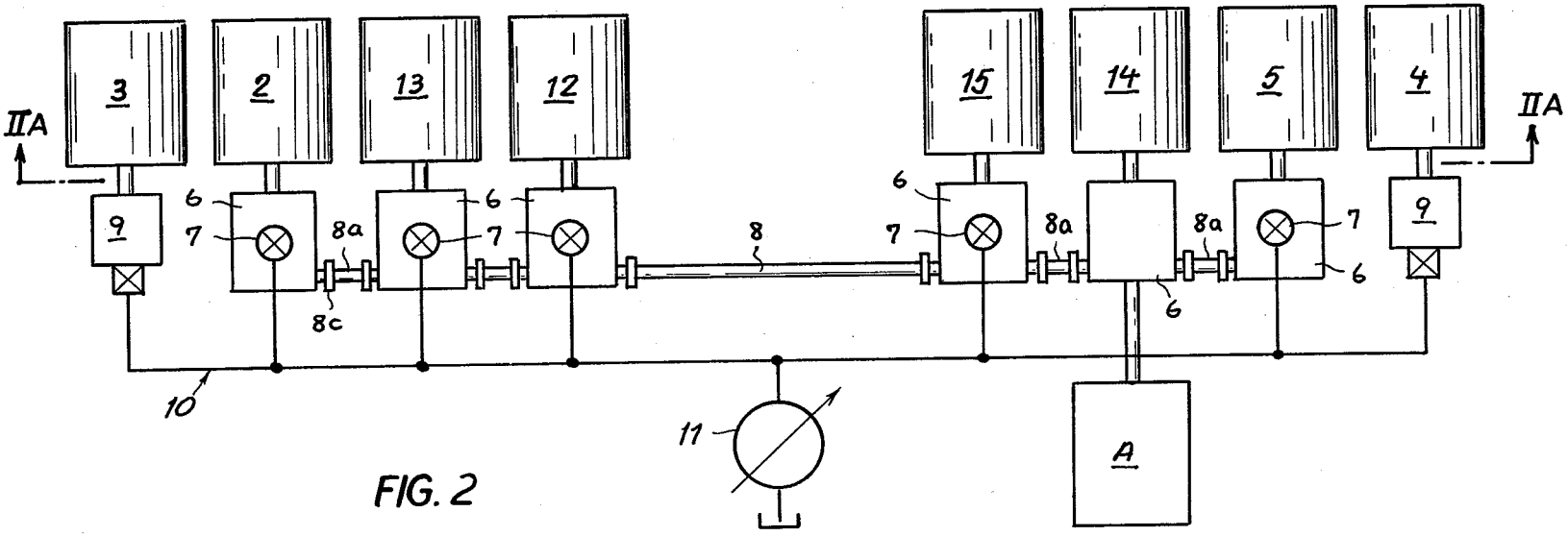
FIG. 2 is a view similar to FIG. 1 diagrammatically illustrating a variant having four drums at the upstream and downstream sides.
Figure 3A:
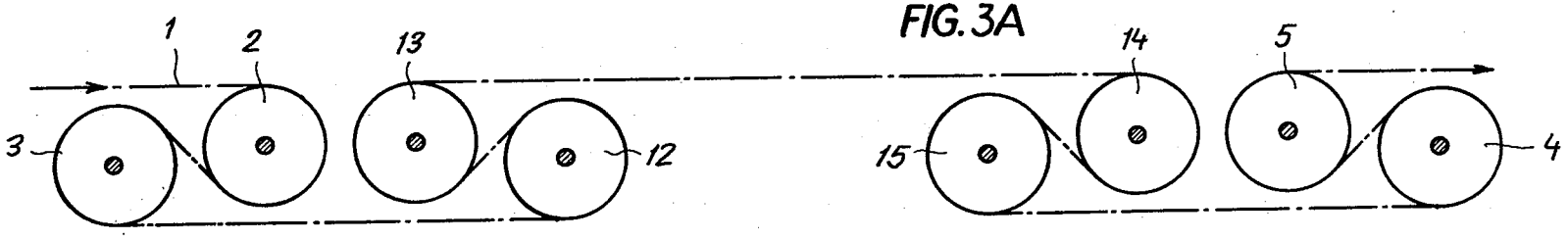
FIG. 3A is a sectional view taken along the line IIIA — IIIA of FIG. 3.
Figure 3:
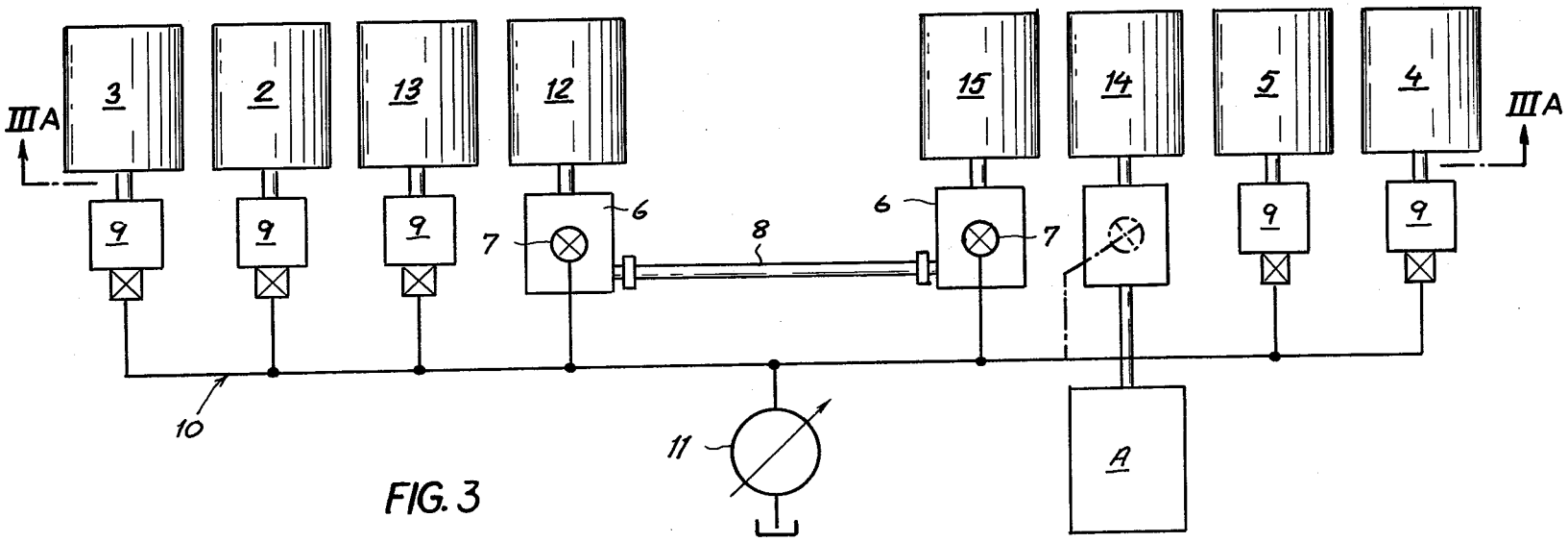
FIG. 3 is a view, again similar to FIG. 1, but illustrating an embodiment of the invention in which the coupling between the two sets is modified from the system of FIG. 2.
Figure 4A:
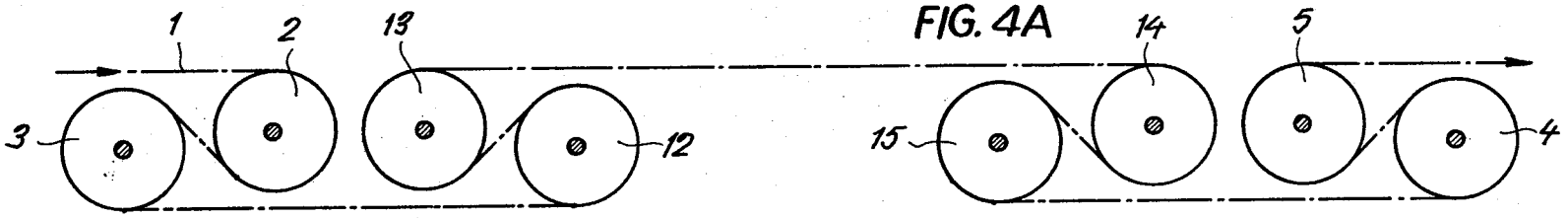
FIG. 4A is a cross section along the line IVA — IVA of FIG. 4.
Figure 4:
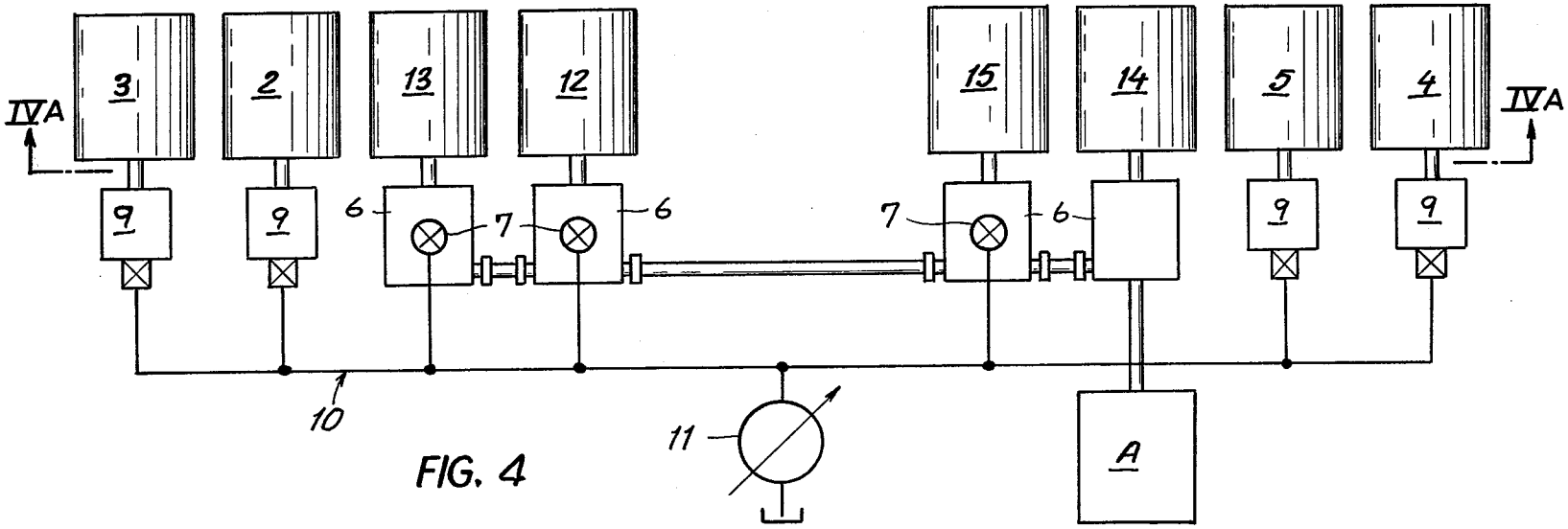
FIG. 4 is a view of another modification of the system of FIGS. 2 and 3, also in diagrammatic plan form.

The embodiments of FIGS. 2 through 4 differ from that of FIGS. 1, 1A and 1B in that each set includes four drums and hence at the upstream set the additional drums 12, 13 are provided while at the downstream set additional drums 14 and 15 are provided.

In the embodiment illustrated in FIGS. 2 and 2A, corresponding elements of each of three-element differential transmissions 6 are connected by shafts 8 and **8*a* while the hydraulic superimposition motors 7 are connected to respective elements of the transmissions of drums 2, 13, 12, 15 and 5. The transmission of drum 14 may be driven by the main drive motor A previously described. Of course, when the band is drawn through this system by a drive arrangement downstream of the stretching apparatus of FIGS. 2 and 2A, the transmission of drum 14 may also be provided with a hydraulic motor 7. All of the hydraulic motors are connected to the common pressure line 10 supplied by the pump 11. The hydraulic motors 9, via respective speed-changing transmissions, are only applied to the outer drums 3, 4 and serve primarily as torque-controlling members. The hydraulic motors of course are connected to the common pressure system 10. As described in connection with FIG. 1B the torques applied from drum to drum along the path of the strip illustrated in FIG. 2A** can be staggered to obtain the desired degree of stretch while the peripheral speeds of the drums are augmented from drum to drum to correspond to the degree of stretch.

The embodiment of FIG. 3 differs from that of FIG. 2 only in that differential transmissions 6 are applied exclusively to the drums 12 and 15, the corresponding elements of the transmissions of drums 12 and 15 being connected by the common shaft 8 and each of these transmissions having a respective superimposition hydraulic motor 7 as previously described. In this case, the drive force can be applied to this system by a motor A directly coupled to the drum 14, e.g. via a speed changing transmission. Of course, this transmission 6' can be provided with a hydraulic motor as shown in broken lines, the motor also being connected to the pressure line 10. In this embodiment, moreover, all of the remaining drums have hydraulic motors 9 and respective speed changing transmissions connected to line 10. Of course, the hydraulic machines of drums 3, 2 and 13 will operate as hydraulic pumps while the machines of drums 5 and 4 will operate as hydraulic motors, the torques being stepped from drum to drum along the path of the strip in the manner previously described.

In the embodiment of FIGS. 4 and 4A, of course, the transmissions 6 are all connected together and each has a hydraulic motor 7 as previously described with the exception of the drum 14 which is driven by the motor A. Otherwise the system operates and is constructed in a manner analogous to that in FIG. 3. This embodiment, however, 2 of the downstream drums and 3 of the upstream drums have hydraulic machines 9 which operate respectively as motors and pumps, connected to the common pressure line 10.

Figure 5:
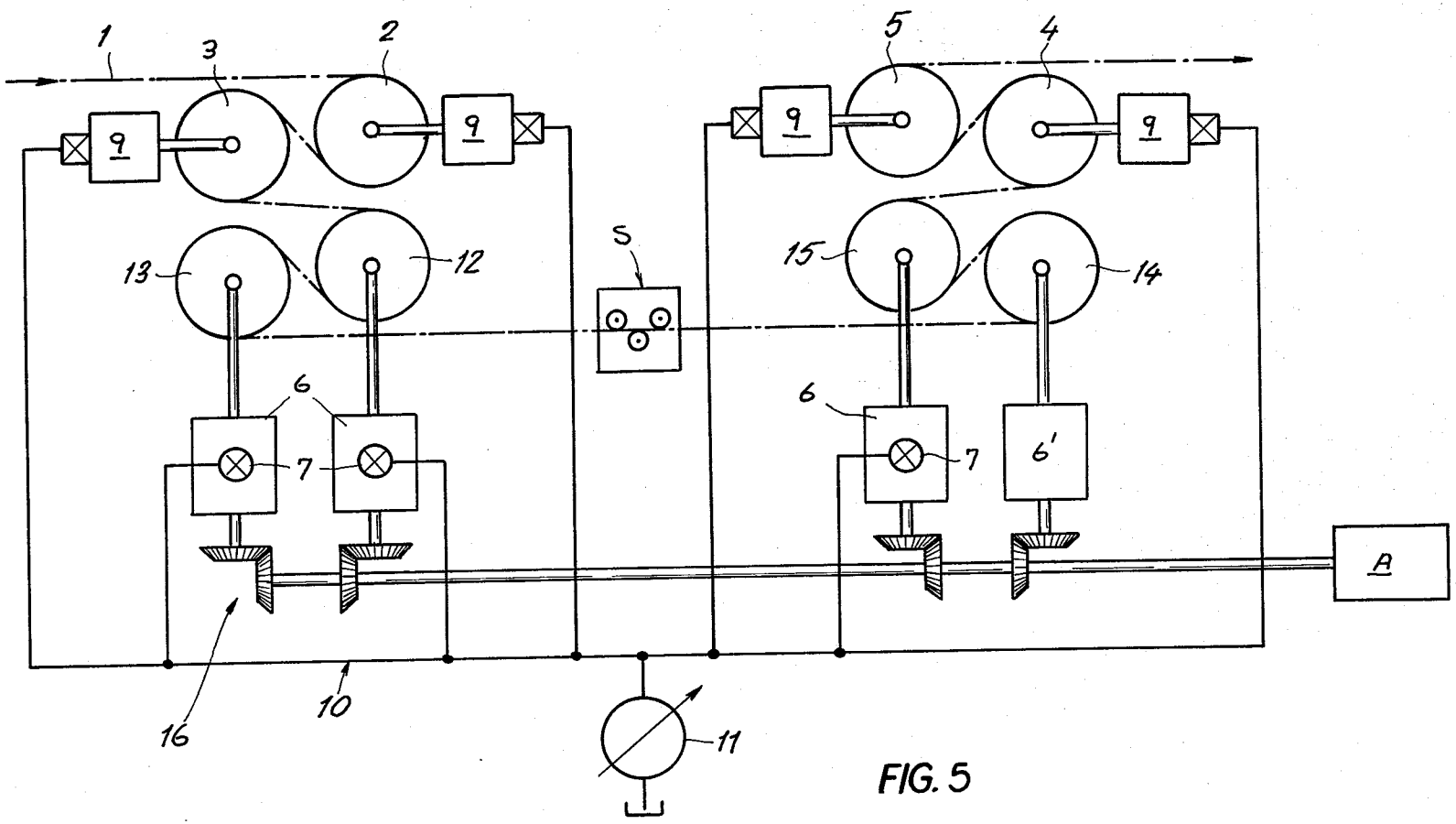
FIG. 5 is a side elevational view in diagrammatic form, of another apparatus embodying the present invention.

The embodiment of FIG. 5 shows how the drums 2 through 5 and 12 through 15 can be disposed in vertically superimposed planes without affecting the operation of the torque controlling and drive arrangement. Between the two sets a straightening device S is provided. The double lines merely represent shaft connections and do not require, naturally, the use of Cardan shafts or universal joints. In this case the drums 12 through 15 are each provided with respective three-element transmissions 6, three of which have respective motors 7 receiving inputs from the pressures line 10. All of the remaining drums have hydraulic motors 9 also connected to the common pressure line 10. The drum 14, however, can have a transmission 6' as shown in FIG. 3 to form the drive element of the system. The inputs to each of the transmissions can be effected by bevel gearing 16 from a common shaft operated by the motor A.

While in most instances the hydraulic motors 9 will serve merely to regulate the torque, it should be understood that they can contribute a driving force for the strip at a suitable pressure of the pump 11. Thus when the load on the drive system A becomes excessive, these hydraulic motors can be used as primary drive elements as well.

I claim:

1. A stretching apparatus for a continuously moving strip which comprises:

a first set of at least two stressing drums at an upstream location and a second set of at least two stressing drums at a downstream location, said strip passing around said drums and advancing from said upstream location to said downstream location under tension;

a respective three-element differential transmission connected to one drum of each of said sets, each of said transmissions having a first element operatively connected to the respective drum, a second element operatively connected to the second element of the other differential transmission by a common shaft and a third element, the first, second and third elements of each transmission being rotatable differentially with respect to one another;

a respective torque-controllable hydraulic machine capable of pump and motor operation connected directly to a respective one of the other drums of said sets;

at least one superimposition hydraulic motor connected to one of said third elements; and common hydraulic pressure means connected to all of said machines and to said hydraulic motor for stepping the torques applied by said hydraulic motor and said hydraulic machines to said drums along the path of said strip, thereby applying a predetermined stretch to said strip.

2. The apparatus defined in claim 1 wherein said transmission and said hydraulic machines are disposed on said sets mirror symmetrically with respect to one another.

3. The apparatus defined in claim 1 wherein a drum experiencing the highest torque at each of said sets is provided with the respective transmission and a drum experiencing the lowest torque at each of said sets is provided with a respective one of said hydraulic machines.

4. The apparatus defined in claim 1 wherein four such drums are provided in each of said sets and at least two of the drums of one of the sets are provided with respective three-element differential transmissions.

5. The apparatus defined in claim 4, further comprising a common shaft connecting corresponding elements of the differential transmission of said two drums of said one set.

6. The apparatus defined in claim 4 wherein two drums of each set are provided with respective three-element differential trasnmissions and corresponding elements of all of said transmissions are provided with respective hydraulic motors.

7. The apparatus defined in claim 4 wherein two drums of each set are provided with respective three-element differential trasnmissions, corresponding elements of all of said transmissions being operatively connected together by common shaft means for synchronous rotation.

8. The apparatus defined in claim 7, further comprising a drive motor for the apparatus connected to said shaft means for rotating same.

9. The apparatus defined in claim 1 wherein the third element of the other transmission is connected to a drive motor.

10. The apparatus defined in claim 1 wherein the third element of the other transmission is provided with a further hydraulic motor.

* * * * *